United States Patent [19]

Schauer et al.

[11] 4,257,666

[45] Mar. 24, 1981

[54] PLUG

[75] Inventors: Friedrich Schauer, Heroldsberg; Manfred Wolff, Schwarzenbruch, both of Fed. Rep. of Germany

[73] Assignee: Kabel-und Metallwerke Gutehoffnungshütte AG., Hanover, Fed. Rep. of Germany

[21] Appl. No.: 967,588

[22] Filed: Dec. 8, 1978

[30] Foreign Application Priority Data

Dec. 19, 1977 [DE] Fed. Rep. of Germany ..... 7738717

[51] Int. Cl.[3] ..... H01R 19/70; H01R 19/72

[52] U.S. Cl. ..... 339/218 M; 339/196 R

[58] Field of Search ..... 339/196 R, 196 M, 107 R, 339/217 R, 217 S, 218 R, 218 M, 208

[56] References Cited

U.S. PATENT DOCUMENTS

| | | | |
|---|---|---|---|
| 3,336,565 | 8/1907 | Crimmins | 339/107 |
| 3,399,373 | 8/1968 | Maki et al. | 339/217 R X |
| 4,017,141 | 4/1977 | Bury et al. | 339/196 M X |

FOREIGN PATENT DOCUMENTS

| | | | |
|---|---|---|---|
| 1147644 | 4/1963 | Fed. Rep. of Germany . | |
| 2043691 | 3/1972 | Fed. Rep. of Germany | 339/210 R |
| 1394871 | 3/1965 | France | 339/20 |

*Primary Examiner*—Eugene F. Desmond

*Attorney, Agent, or Firm*—Smyth, Pavitt, Siegemund & Martella

[57] ABSTRACT

A plug for female contacts is comprised of a control carrier member with hinged interlocking parts for sealingly gripping the inserted conductor ends of a cable. The interlocked parts and adjacent conductor portions are molded in a plastic body.

4 Claims, 4 Drawing Figures

PLUG

BACKGROUND OF THE INVENTION

The present invention relates to a female type plug for connection to the conductors of an electric cable or the like.

A plug of the type to which the invention pertains is usually comprised of a rather strong piece made of an insulating material and serving primarily as support for resilient, metal contacts, to which are connected the conductors or leads of the cable which terminates in the plug. This rather strong piece or member is embedded or otherwise enclosed in parts by an insulative protection. The contacts are, for example, inserted in recesses of the member in a manner permitting lateral displacement upon contact making with inserted prongs of a male plug.

The German printed patent application No. 1,147,644 discloses a plug of the type as described. The contacts (12 in the printed application) are positioned in a carrier member (10) for resilient lateral displacement. Moreover, the contacts (12) are inserted in a manner sealing the openings (21), and are configured accordingly. The protective body (6) is molded around the contact carrying member (10), plastic material will not (or should not) penetrate into the contact containing openings (21). The contact is made along a line in each instance, and a rather high degree of accuracy is required (small tolerances) so that interior remains sealed. The carrier member (10) is rather thick and does not participate in the sealing.

Generally speaking, a cable or e.g. an extension cord may be provided with such a female plug on one end, while the other end is provided with a male plug. Such a cable has a variety of uses, among them is the use as conductor leading to a distributor in an automobile, or serving as an extension for audio equipment. It must be expected that the plug body is relatively frequently handled and should, therefore, be appropriately strong so that it may last for a long time. In many cases, such as in an automobile, the plug must be quite resistant to high temperatures as they occur in the vicinity of the engine.

A construction is known in which the body carrying contact sleeves is made of soft elastic material so that the body adds to the resiliency of the engaging contact. However, such plastic may age more or less rapidly, and fatigue in the material may cause the contact making force to be reduced below safe values.

DESCRIPTION OF THE INVENTION

It is an object of the present invention to provide a new and improved female plug containing contacts whose resiliency does not depend on the material employed for supporting or carrying them.

It is another object of the present inventin to provide a new and improved plug for female contacts in which the space occupied by the contacts as well as by any inserted prongs is kept free and sealed.

It is a particular object of the present invention to improve plugs constructed, basically, from a contact carrying hollow carrier member and a molded-on protection for embedding the conductors leading into the carrier member.

In accordance with the preferred embodiment of the present invention, it is suggested to provide the carrier member as per the specific object with two hinged parts which are disengaged for inserting the conductor ends with contacts affixed thereto, and which interlock thereafter thereby sealingly gripping the conductors and sealingly closing off the rear of the carrier member, a protective body is molded around the interlocked hinge members, covering also the adjacent portions of the conductors.

It can thus be seen that the interior space of the contact carrier is not sealed by the contacts but by the interlocked hinge members so that plastic subsequently molded on will not enter. Rather, that plastic will reenforce the sealing engagement of the hinge parts. The contacts can be provided in any convenient fashion, permitting for resilient and elastic cooperation with inserted prongs. Positive gripping of the conductors by the interlocked hinge parts as additionally urged towards each other by the molded-on portion serves also as tension relief of the connection between the contacts and the conductors.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
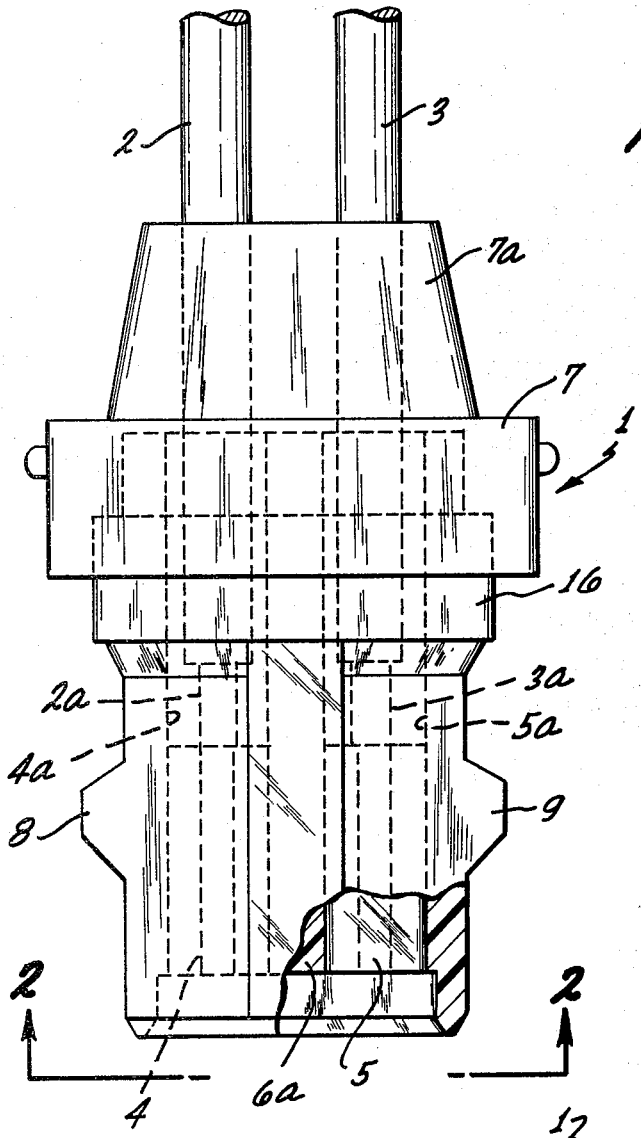
FIG. 1 is a side view of a plug in accordance with the preferred embodiment.
Figure 2:
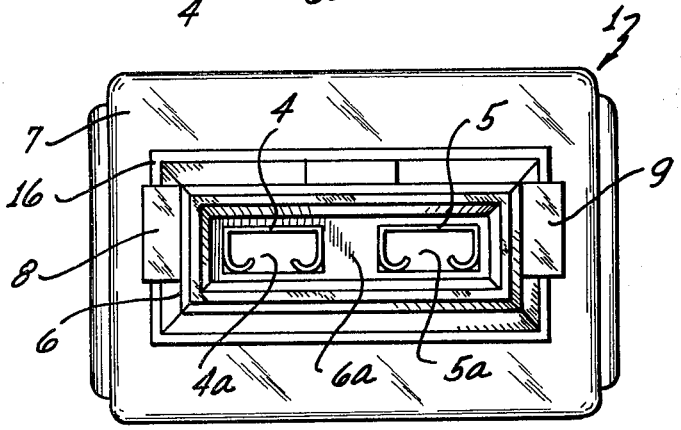
FIG. 2 is a front view of the plug as indicated by lines 2—2 in FIG. 1.

Proceeding now to the detailed description of the drawings, the figures show a plug 1 for female contacts and being connected to stripped ends of insulated conductors 2 and 3. The plug is basically comprised of an insert or carrier body 6; a molded-on protection member 7, possibly of the same material and two contacts 4 and 5 shown in front view in FIG. 2 and contained in the carrier member 6.

Figure 3:
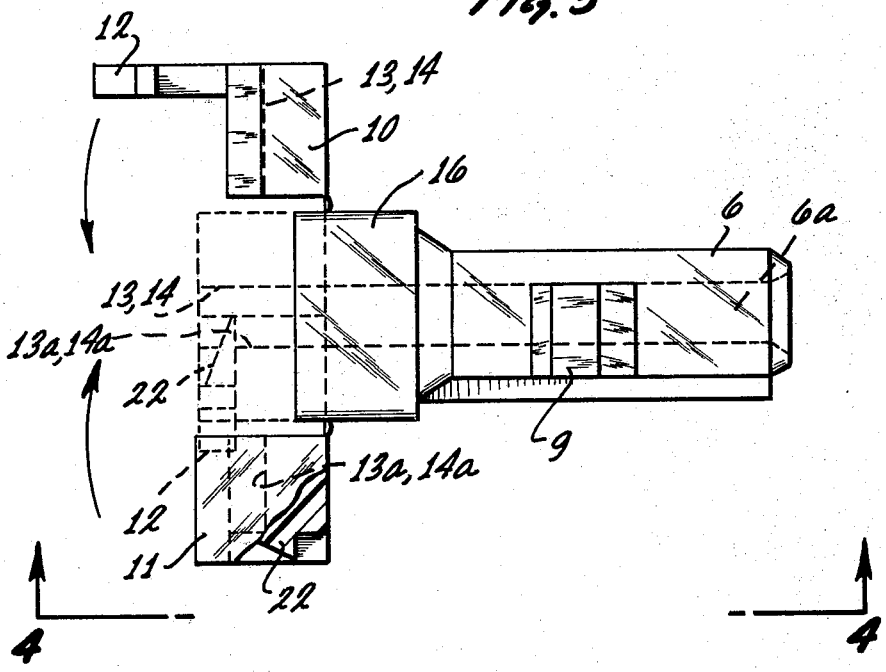
FIG. 3 is an insert for and in the plug as shown in FIGS. 1 and 2.
Figure 4:
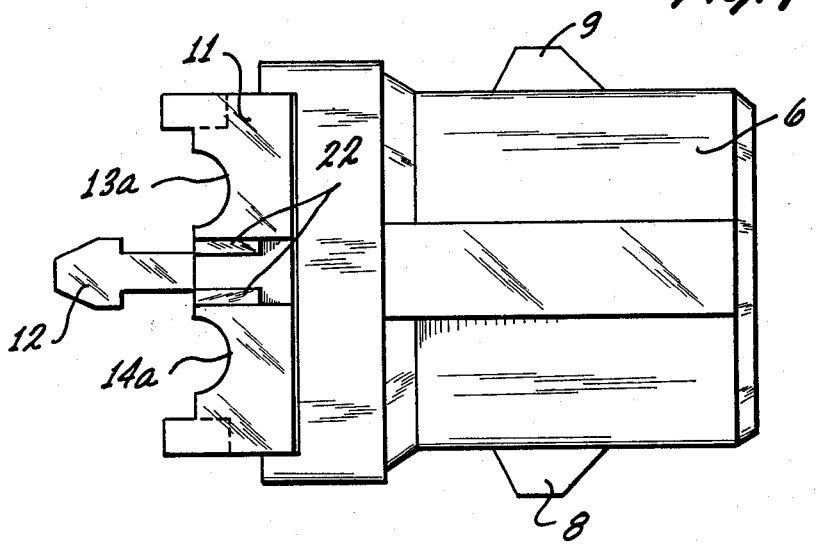
FIG. 4 is a view of that insert taken along lines 4—4 in FIG. 3.

The carrier member 6 of the plug is made of a rather strong insulating material, such as polyamid. FIGS. 3 and 4 show that member in greater detail. The contacts 4 and 5 are disposed in recesses **4*a* and 5*a* of that carrier which, however, may communicate in a single continuous opening. However, a ridge or barrier 6*a* should be provided to separate the contacts. The openings continue towards the rear of member 6, at similar dimensions and into an enlarged portion 16 of member 6**.

The extension 16 is provided with two hinge members 10 and 11, hinged to the extension along opposite rear edges. The disposition of the hinge members is shown in FIGS. 3 and 4 in the unassembled or preassembly state. These hinge members have half cylindrical recesses such as 13 and 14 of member 10 and companion, complementary recesses such as **13*a* , 14*a* of member 11**.

These recesses 13, etc. define in pairs (such as 14 and **14*a*) as well as 13 and 13*a*, two cylindrical ducts when the hinge members 10 and 11 are folded together. A latch tongue 12 or member 10 will then snap behind projections 22 in a recess of member 11 to thereby interlock the two members 10 and 11**.

The plug is assembled and completed in the following manner. The ends of the insulated conductors 2 and 3 have their insulation stripped to bare conductors proper 2*a* and 3*a*, and the contact pieces 4 and 5 are, respectively, connected thereto, e.g. by soldering or welding. The ends of the conductors 2 and 3 now carry the contacts 4, 5 and they are inserted from the rear (extension 16) into the hollow interior (4*a*, 5*a*) of carrier member 6; the hinge parts being open as shown in FIGS. 3 and 4.

After the contacts 4 and 5 have been appropriately positioned in member 6, the two hinge parts 10 and 11 are pivoted each by about 90° from the position shown in FIG. 3, and towards each other, whereby the recesses, such as 13, 14, etc., respectively, receive in pairs the conductor ends 2,3, preferably adjacent to still insulated portions thereof. As the latch 12, 22 snaps shut, the position of the contact carrying conductors should be arrested. Preferably, the dimensions are chosen so that the ducts made up from complimentary recesses 13, 13*a*, and 14, 14*a*, have slightly smaller diameter than the outer diameter of the conductors. Thus, the conductors are clamped into the interlocked hinge parts. In fact, the resulting seal should be airtight. Moreover, the hinge parts should be dimensioned that upon locking of latch parts 12, 22 the interface between the parts 10 and 11 should also be airtight, with no gap in-between.

The preassembly of carrier 6 with contact carrying cable ends is now placed into a die casting, injection molding, and/or vulcanizing or other suitable plastic forming and molding tool or machine, to cast and mold the body 7 around that end of carrier 6 having the extension 16. One may use the same plastic, e.g. polyamid for the members 6 and 7.

The extension 16 will be embedded in parts of the body 7, while the interlocked hinge members are fully embedded. The portion 7*a* of that body embeds the hinges and cable ends as projecting from the interlocked hinge parts 10 and 11. This end of carrier 6 is thus additionally sealed against any ingress of moisture.

The molding process as such re-enforces the seal as between the hinge members and urges them to more tightly clamp the conductors 2 and 3. In fact, the conductors 2 and 3 are now positively gripped by the hinge members as embedded, so that any tension on the conductors is, in fact, fully taken up by the carrier member 6, and does not load the contacts and the connection between the contacts and the conductors. Moreover, the contacts and conductor ends are held by this gripping action against the force resulting from pushing contact prongs into contacts 4,5. The shape and contour of plug 1 is shown here by way of example only. It will readily be understood that portion 16 of member 6 may have a 90° displaced orientation to the rest of the member (or a smaller angle can be chosen) to obtain an angle type plug. It is only necessary to bend the conductors 2 and 3 at their contact carrying end to accommodate this different orientation. The body 7 will be analogously of angled-off configuration.

The invention is not limited to the embodiments described above but all changes and modifications thereof not constituting departures from the spirit and scope of the invention are intended to be included.

We claim:

1. A female plug for electrical connections and cooperation with a male plug, comprising:

a carrier member of internally open construction, being particularly open in a front and rear opposite the front;

a pair of hinge members, hinged along opposite edges of the rear of said carrier member, and provided with snap-on lock means to be locked together for air-tightly holding the hinge members together, the hinge members each having complementary duct means, together defining ducts for respectively receiving, holding, and clamping airtight two conductors, said hinge members when unlocked opening the interior of the carrier member for access from the rear;

a pair of contacts, respectively connected to the ends of the conductors and disposed in said interior as adjacent portions of the conductors are held in the said duct means by the locked-together hinge parts, said contacts configured to resiliently yield laterally upon insertion of male contacts, without impediment by the carrier member; and a protective plug body, molded around and embedding the interlocked hinge members and embedding portions of the conductors extending outwardly from the interlocked hinge members.

2. The carrier member in claim 1, the hinge members having latch means for interlocking.

3. The plug as in claim 1, said carrier member and said plug body being made from the same material.

4. A female plug for electrical connections and cooperation with a male plug, comprising:

a carrier member of internally open construction, being particularly open in a front and a rear opposite the front;

a pair of hinge members, hinged along opposite edges of the rear of the carrier member, each having a flat interface surface and recesses, the hinge members when hinged towards each other, having the respective flat surfaces engage each other and the recesses define a pair of ducts for receiving insulated conductors;

snap-on lock means on the hinge members for interengagement when the members are hinged towards each other to, thereby, airtightly clamp the conductors in the ducts while airtightly holding the interface surfaces in engagement;

the conductors carrying female contacts, being held in the interior of the carrier member and being configured to resiliently yield laterally upon insertion of male contacts without impediment by the carrier member; and a protective, relatively soft plastic plug body, having been molded around the interlocked hinge members for embedding them as well as a portion of the conductors extending outwardly from the interlocked hinge members.

* * * * *